US011524500B2

(12) United States Patent
Nakano et al.

(10) Patent No.: US 11,524,500 B2
(45) Date of Patent: Dec. 13, 2022

(54) LIQUID EJECTION APPARATUS AND SYSTEM INCLUDING LIQUID EJECTION APPARATUS

(71) Applicant: BROTHER KOGYO KABUSHIKI KAISHA, Nagoya (JP)

(72) Inventors: Yasuhiro Nakano, Nagoya (JP); Yuta Toda, Nagoya (JP); Zenichiro Sasaki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/031,158

(22) Filed: Sep. 24, 2020

(65) Prior Publication Data

US 2021/0086517 A1 Mar. 25, 2021

(30) Foreign Application Priority Data

Sep. 25, 2019 (JP) ..... JP2019-173989

(51) Int. Cl.
*B41J 2/045* (2006.01)
*B41J 2/165* (2006.01)
*B41J 3/46* (2006.01)

(52) U.S. Cl.
CPC ..... *B41J 2/16579* (2013.01); *B41J 2/0451* (2013.01); *B41J 2/04573* (2013.01); *B41J 2002/16573* (2013.01)

(58) Field of Classification Search
CPC ..... B41J 2/165
See application file for complete search history.

(56) References Cited

U.S. PATENT DOCUMENTS 6,045,206 A * 4/2000 Igval ..... B41J 2/01 347/19
2002/0130918 A1* 9/2002 Hayakawa ..... B41J 2/16532 347/29
2006/0092211 A1* 5/2006 Arakawa ..... B41J 2/16579 347/19
2006/0157579 A1 7/2006 Komatsu
2007/0139461 A1 6/2007 Izuo
(Continued)

FOREIGN PATENT DOCUMENTS

JP 2004-046561 A 2/2004
JP 2006-175849 A 7/2006
(Continued)

*Primary Examiner* — Shelby L Fidler
(74) *Attorney, Agent, or Firm* — Baker Botts L.L.P.

(57) ABSTRACT

There is provided a liquid ejection apparatus, including: a head; a signal output circuit; a discharge mechanism; a controller; and a memory in which association information is stored. The controller is configured to: diagnose a degree of defectiveness of the head based on a signal from the signal output circuit; and receive, from a user, an input of discharge amount information. In response to the input of the discharge amount information, the controller is configured to: control the discharge mechanism to discharge a liquid by a discharge amount corresponding to the discharge amount information; and change the association in the association information based on the discharge amount corresponding to the discharge amount information and a discharge amount that corresponds to the degree of the defectiveness of the head.

15 Claims, 12 Drawing Sheets

(56) References Cited

U.S. PATENT DOCUMENTS

| | | | | |
|---|---|---|---|---|
| 2010/0245436 | A1 | 9/2010 | Nishida | |
| 2014/0300657 | A1 | 10/2014 | Ike | |
| 2017/0050440 | A1* | 2/2017 | Takata | B41J 2/16526 |
| 2018/0086081 | A1* | 3/2018 | Sakamoto | B41J 2/16526 |
| 2021/0170772 | A1* | 6/2021 | Maeda | B41J 2/17546 |

FOREIGN PATENT DOCUMENTS

| | | | |
|---|---|---|---|
| JP | 2007-007960 | A | 1/2007 |
| JP | 4900411 | B2 | 3/2012 |
| JP | 4929699 | B2 | 5/2012 |
| JP | 5434171 | B2 | 3/2014 |
| JP | 2015-178178 | A | 10/2015 |
| JP | 6231759 | B2 | 11/2017 |

* cited by examiner

Fig. 8A

| DEGREE OF DEFECTIVENESS OF HEAD | SMALL | MEDIUM | LARGE |
|---|---|---|---|
| KIND OF PURGE | NORMAL | STRONG | STRONGEST |

Fig. 8B

| DEGREE OF DEFECTIVENESS OF HEAD | SMALL | MEDIUM | LARGE |
|---|---|---|---|
| KIND OF PURGE | NORMAL | NORMAL | STRONG |

Fig. 8C

| DEGREE OF DEFECTIVENESS OF HEAD | SMALL | MEDIUM | LARGE |
|---|---|---|---|
| KIND OF PURGE | STRONG | STRONGEST | STRONGEST |

Fig. 11A

| PURGE STRENGTH | NORMAL | STRONG | STRONGEST |
|---|---|---|---|
| PUMP DRIVING TIME | T1 | T2(>T1) | T3(>T2) |

Fig. 11B

| PURGE STRENGTH | NORMAL | STRONG | STRONGEST |
|---|---|---|---|
| PUMP ROTATION VELOCITY | U1 | U2(>U1) | U3(>U2) |

LIQUID EJECTION APPARATUS AND SYSTEM INCLUDING LIQUID EJECTION APPARATUS

CROSS REFERENCE TO RELATED APPLICATION

The present application claims priority from Japanese Patent Application No. 2019-173989 filed on Sep. 25, 2019, the disclosure of which is incorporated herein by reference in its entirety.

BACKGROUND

Field of the Invention

The present disclosure is related to a liquid ejection apparatus configured to eject a liquid from nozzles and a system including the liquid ejection apparatus.

Description of the Related Art

As an exemplary liquid ejection apparatus configured to eject a liquid from nozzles, there is a publicly known ink-jet printer that performs printing by ejecting ink from nozzles. In the publicly known ink-jet printer, whether ink is ejected is inspected for each of the nozzles in a head. When there is a nozzle from which ink is not ejected, a maintenance operation is performed, and the inspection is performed again.

SUMMARY

In the publicly known ink-jet printer, a predefined amount of ink that is set in advance is discharged in the maintenance operation. However, there are many kinds of users of the ink-jet printers, such as users who want to reduce an ink consumption amount as much as possible in exchange for deterioration in image quality and users who want to obtain high image quality in exchange for a large ink consumption amount. Such user's preferences may not reflect on the configuration in which the uniform amount of ink that is set in advance is discharged in the maintenance operation.

An object of the present disclosure is to provide a liquid ejection apparatus that is capable of discharging a liquid to restore or recover an ejection defective nozzle depending on user's preference and a system including the liquid ejection apparatus.

According to an aspect of the present disclosure, there is provided a liquid ejection apparatus, including: a head in which a plurality of nozzles are open, a signal generator configured to output a signal such that the signal varies depending on whether an ejection defective nozzle having defectiveness in liquid ejection is included in the nozzles, a discharge mechanism configured to perform a discharge operation in which a liquid in the head is discharged from the nozzles, a controller, and a memory. The controller is configured to: diagnose a degree of the defectiveness of the head by performing defectiveness determination to determine, based on the signal from the signal generator, whether the ejection defective nozzle is included in the nozzles; and receive, from a user, an input of discharge amount information that is based on a result of the defectiveness determination and is related to a discharge amount of the liquid in the discharge operation. The memory is configured to store association information including the degree of the defectiveness of the head associated with the discharge amount of the liquid in the discharge operation. In response to the input of the discharge amount information, the controller is configured to: control the discharge mechanism to discharge the liquid by a discharge amount corresponding to the discharge amount information; and change the association in the association information based on the discharge amount corresponding to the discharge amount information and a discharge amount in the association information that corresponds to the degree of the defectiveness of the head indicated by the result of the defectiveness determination.

According to another aspect of the present disclosure, there is provided a system including: a plurality of liquid ejection apparatuses; and a server communicably connected to the liquid ejection apparatuses. Each of the liquid ejection apparatuses includes: a head in which a plurality of nozzles are open, a signal generator configured to output a signal such that the signal varies depending on whether an ejection defective nozzle having defectiveness in liquid ejection is included in the nozzles, a discharge mechanism configured to perform a discharge operation in which a liquid in the head is discharged from the nozzles, a controller and a memory. The controller is configured to: diagnose a degree of the defectiveness of the head by performing defectiveness determination to determine, based on the signal from the signal generator, whether the ejection defective nozzle is included in the nozzles; and receive, from a user, an input of discharge amount information that is based on a result of the defectiveness determination and is related to a discharge amount of the liquid in the discharge operation. The memory is configured to store association information including the degree of the defectiveness of the head associated with the discharge amount of the liquid in the discharge operation. In response to the input of the discharge amount information, the controller is configured to: control the discharge mechanism to discharge the liquid by a discharge amount corresponding to the discharge amount information; and transmit information about the degree of the defectiveness of the head indicated by the result of the defectiveness determination and information about the discharge amount of the liquid corresponding to the discharge amount information, to the server. The server is configured to transmit change information by which the association in the association information is changed, to each of the liquid ejection apparatuses, based on the information about the degree of the defectiveness of the head and the information about the discharge amount of the liquid that are transmitted from each of the liquid ejection apparatuses. In each of the liquid ejection apparatuses, the controller is configured to change the association in the association information based on the change information transmitted from the server.

According to the present disclosure, it is possible to change, depending on user's preference or the like, the association in the association information in which the degree of defectiveness of the head is associated with the discharge amount of the liquid in the discharge operation.

BRIEF DESCRIPTION OF THE DRAWINGS

FIG. 8A illustrates association information in which degrees of defectiveness of an ink-jet head 4 are associated with purge strengths, FIG. 8B is a diagram corresponding to FIG. 8A and indicating an example in which an ink discharge amount is reduced, and FIG. 8C is a diagram corresponding to FIG. 8A and indicating an example in which the ink discharge amount is increased.

FIG. 11A indicates the second information according to the first modified embodiment, and FIG. 11B indicates the second information according to the second modified embodiment.

DESCRIPTION OF THE EMBODIMENTS

An embodiment of the present disclosure is explained below.

<Schematic Configuration of Printer>

Figure 1:
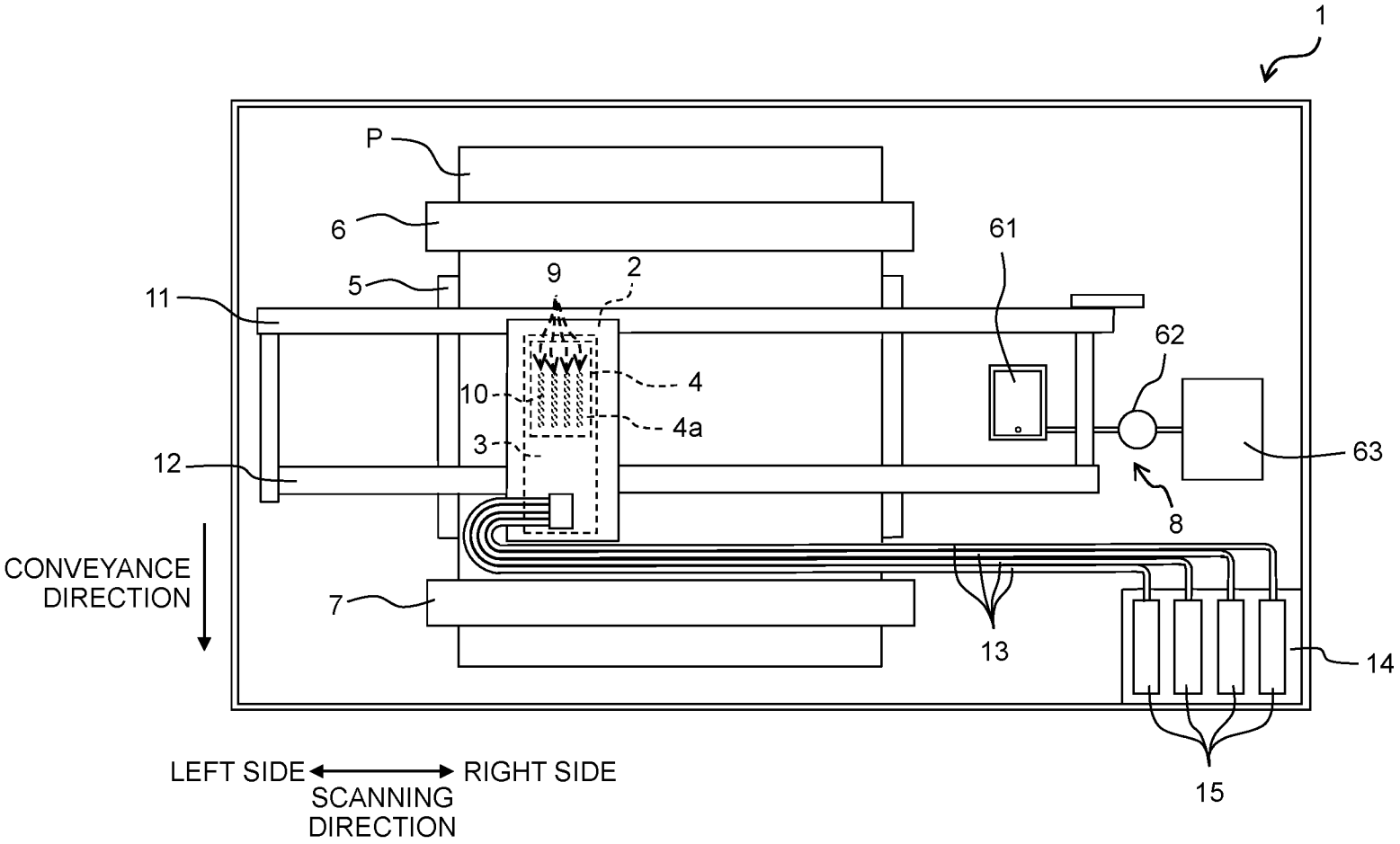
FIG. 1 schematically depicts a configuration of a printer according to an embodiment of the present disclosure.

As depicted in FIG. 1, a printer 1 ("liquid ejection apparatus" of the present disclosure) according this embodiment includes a carriage 2, a subtank 3, an ink-jet head 4 ("head" of the present disclosure), a platen 5, conveyance rollers 6 and 7, a maintenance unit 8 ("discharge mechanism" of the present disclosure), and the like.

The carriage 2 is supported by two guide rails 11 and 12 extending in a scanning direction. The carriage 2 is connected to a carriage motor 86 (see FIG. 4) via a belt (not depicted). Driving the carriage motor 86 moves the carriage 2 along the guide rails 11 and 12 in the scanning direction. In the following description, the right and left sides in the scanning direction are defined as indicated in FIG. 1.

The carriage 2 carries the subtank 3. The printer 1 includes a cartridge holder 14. Four ink cartridges 15 are removably installed in the cartridge holder 14. The ink cartridge 15 disposed on the rightmost side in the scanning direction contains a black ink, the second rightmost ink cartridge 15 contains a yellow ink, the third rightmost ink cartridge 15 contains a cyan ink, and the leftmost ink cartridge 15 contains a magenta ink. Each of the black, yellow, cyan, magenta inks is a "liquid" of the present disclosure. The subtank 3 is connected to the four ink cartridges 15 installed in the cartridge holder 14 via four tubes 13. This allows the four color inks to be supplied from the four ink cartridges 15 to the subtank 3.

The carriage 2 carries the ink-jet head 4. The ink-jet head 4 is connected to a lower end of the subtank 3. The inks of the four colors are supplied from the subtank 3 to the ink-jet head 4. Further, nozzles 10 are formed in a nozzle surface 4*a* that is a lower surface of the ink-jet head 4. The inks are ejected from the nozzles 10. More specifically, the nozzles 10 form four nozzle rows 9 arranged in the scanning direction. In each nozzle row 9, the nozzles 10 are arranged in a conveyance direction orthogonal to the scanning direction. Different colors of inks are ejected from the respective four nozzle rows 9. In the ink-jet head 4, the black ink is ejected from the nozzles 10 belonging to the rightmost nozzle row 9 in the scanning direction, the yellow ink is ejected from the nozzles 10 belonging to the second rightmost nozzle row 9, the cyan ink is ejected from the nozzles 10 belonging to the third rightmost nozzle row 9, and the magenta ink is ejected from the nozzles 10 belonging to the leftmost nozzle row 9.

The platen 5 is disposed below the ink-jet head 4 and faces the nozzles 10. The platen 5 extends over an entire length of a recording paper P in the scanning direction, and supports the recording paper P from below. The conveyance roller 6 is disposed upstream of the ink-jet head 4 and the platen 5 in the conveyance direction. The conveyance roller 7 is disposed downstream of the ink-jet head 4 and the platen 5 in the conveyance direction. The conveyance rollers 6 and 7 are connected to a conveyance motor 87 (see FIG. 4) through gears (not depicted). Driving the conveyance motor 87 rotates the conveyance rollers 6 and 7, thus conveying the recording paper P in the conveyance direction.

The maintenance unit 8 includes a cap 61, a suction pump 62, and a waste liquid tank 63. The cap 61 is disposed on the right side of the platen 5 in the scanning direction. When the carriage 2 is positioned at a maintenance position on the right side of the platen 5 in the scanning direction, the nozzles 10 face the cap 61.

Figure 4:
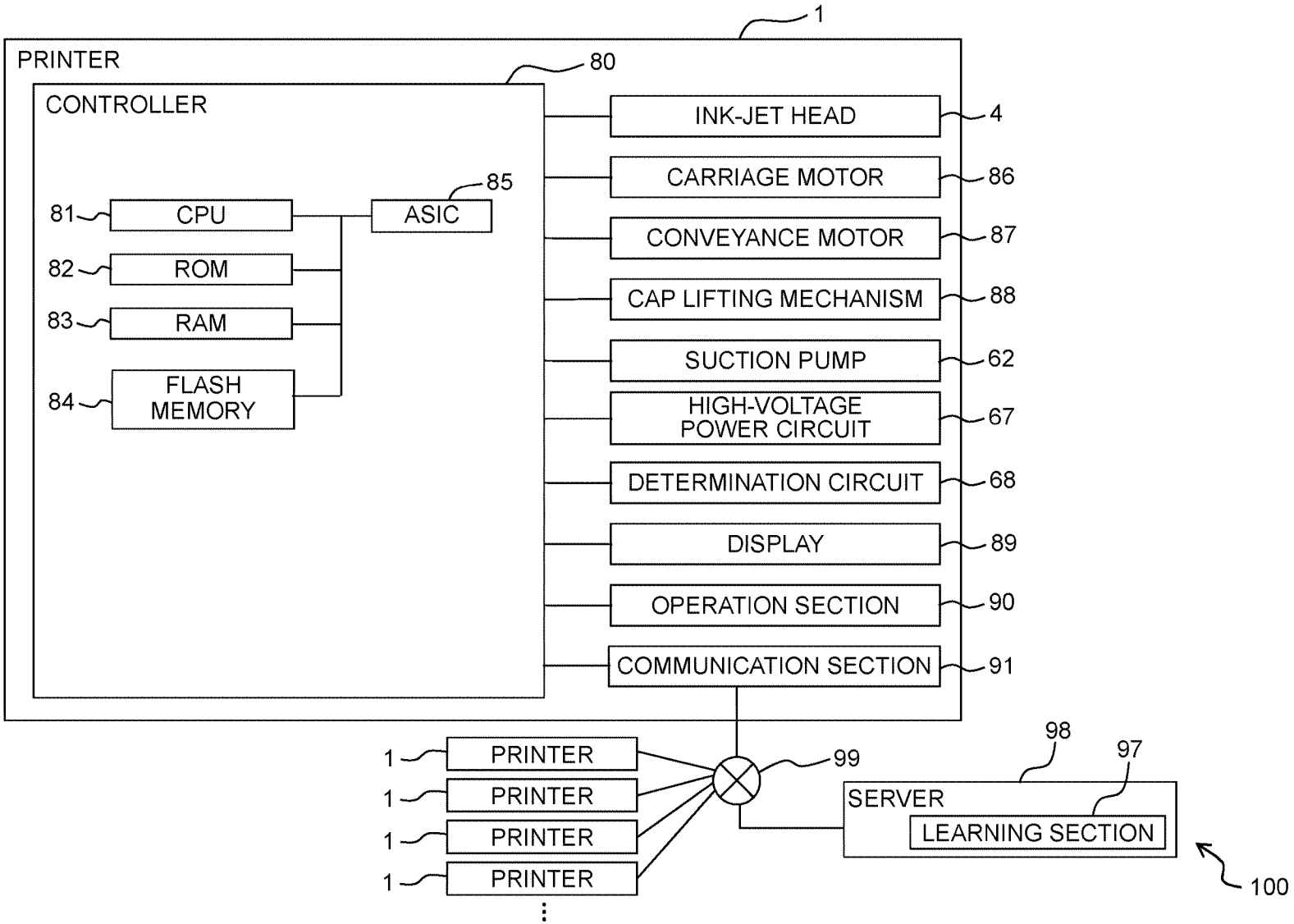
FIG. 4 is a block diagram depicting an electrical configuration of the printer.

The cap 61 can move up and down by a cap lifting mechanism 88 (see FIG. 4). The cap 61 can move upward by the cap lifting mechanism 88 in a state where the carriage 2 is positioned at the maintenance position and the nozzles 10 face the cap 61. In this case, an upper end of the cap 61 is brought into close contact with the nozzle surface 4*a*, and the nozzles 10 are covered with the cap 61. The cap 61 is not limited to covering the nozzles 10 by being brought in close contact with the nozzle surface 4*a*. For example, the cap 61 may cover the nozzles 10 by being brought in close contact with a frame (not depicted) or the like disposed around the nozzle surface 4*a* of the ink-jet head 4.

The suction pump 62 is a tube pump or the like. The suction pump 62 is connected to the cap 61 and the waste liquid tank 63. In the maintenance unit 8, the suction pump 62 is driven in a state where the nozzles 10 are covered with the cap 61. This discharges inks in the ink-jet head 4 from the nozzles 10. Accordingly, the maintenance unit 8 can perform a so-called suction purge. The inks discharged from the ink-jet head 4 are held in the waste liquid tank 63.

In this embodiment, as the suction purge, it is possible to selectively perform any of three kinds of suction purges including "NORMAL", "STRONG", and "STRONGEST" through the control by a controller 80 described below. The suction purge of "STRONG" has an ink discharge amount larger than the suction purge of "NORMAL". The suction purge of "STRONGEST" has an ink discharge amount larger than the suction purge of "STRONG". Here, for example, a driving time of the suction pump 62 is longer as the ink discharge amount used for the suction purge is larger. Or, for example, a rotating velocity of the suction pump 62 is faster as the ink discharge amount used for the suction purge is larger.

The above explanation is made on the assumption that the cap 61 covers all the nozzles 10 collectively and the inks in the ink-jet head 4 are discharged from all the nozzles 10 in the suction purge, for the sake of convenience. The present disclosure, however, is not limited to such an aspect. For example, a portion covering the nozzles 10 that belong to the rightmost nozzle row 9 from which the black ink is discharged and a portion covering the nozzles 10 that belong to the remaining three nozzle rows 9 that are disposed on the left of the rightmost nozzle row 9 and from which color inks (yellow, cyan, and magenta inks) are discharged may be separately provided in the cap 61. Any of the black ink and the color inks in the ink-jet head 4 may be selectively discharged in the suction purge. Or, for example, the cap 61 may be provided for each of the nozzle rows 9. Each of the inks may be discharged from the nozzles 10 belonging to the corresponding one of the nozzle rows 9 in the suction purge.

Figure 2:
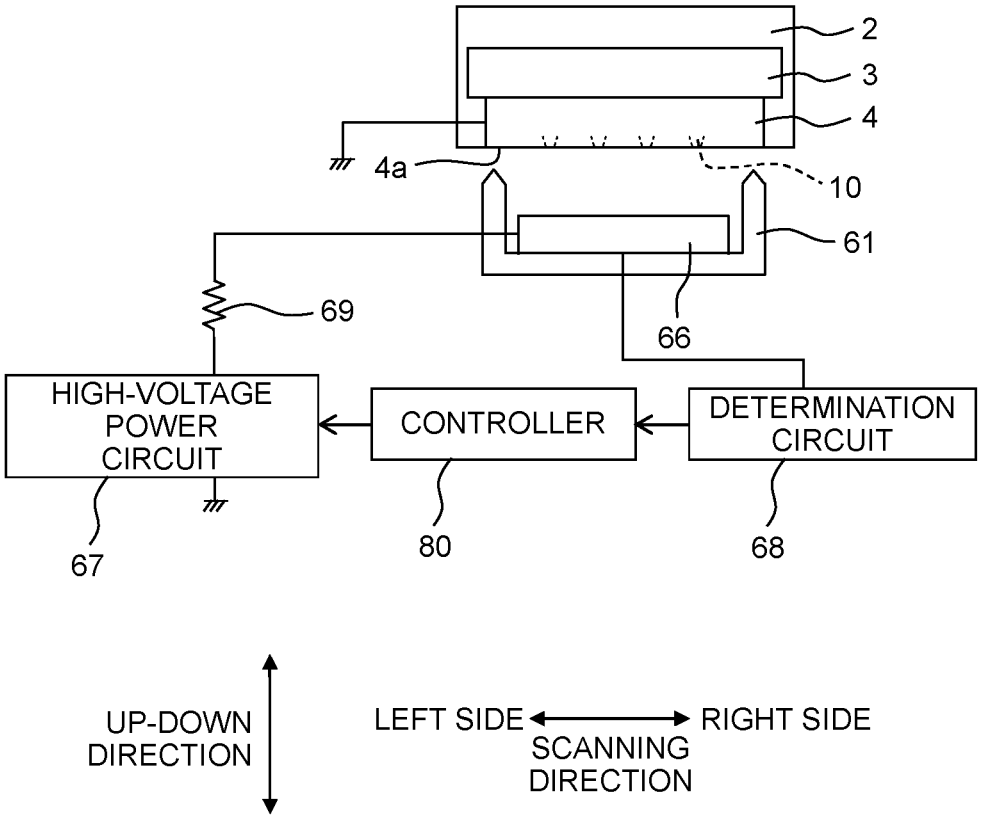
FIG. 2 illustrates a detection electrode disposed in a cap and illustrates a connection relationship between the detection electrode and a high-voltage power supply circuit and a connection relationship between the detection electrode and a determination circuit.

As depicted in FIG. 2, a detection electrode 66 having a rectangular shape in plan view is disposed in the cap 61. The detection electrode 66 is connected to a high-voltage power supply circuit 67 via a resistance 69. The high-voltage power supply circuit 67 applies a predefined positive potential (e.g., about 300 V) to the detection electrode 66. The ink-jet head 4 is kept at the ground potential. This generates a predefined potential difference between the ink-jet head 4 and the detection electrode 66. A determination circuit 68 is connected to the detection electrode 66. The determination circuit 68 compares a voltage value of a voltage signal output from the detection electrode 66 with a threshold value Vt, and outputs a signal depending on the result.

Figure 3A:
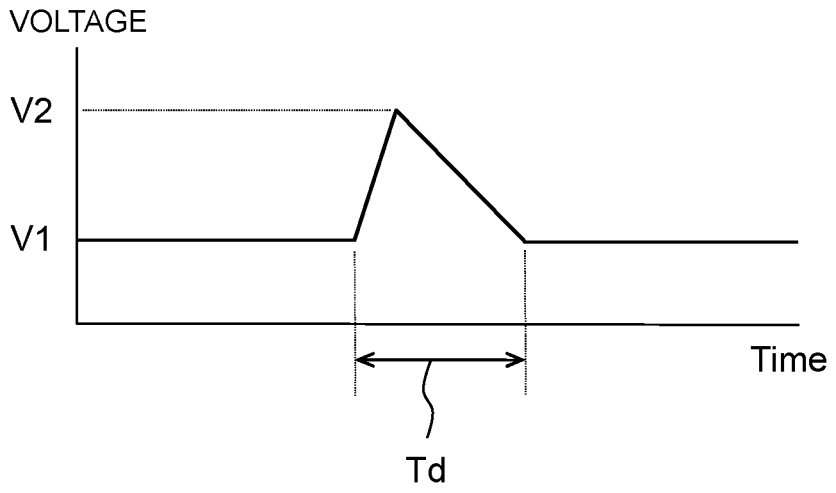
FIG. 3A depicts a change in voltage value of the detection electrode when ink is ejected from a nozzle.

More specifically, since the potential difference is generated between the ink-jet head 4 and the detection electrode 66, the ink ejected from the nozzle 10 is charged. When ink is ejected from the nozzle 10 toward the detection electrode 66 in a state where the carriage 2 is positioned at the maintenance position, the voltage value of the detection electrode 66 rises until the charged ink approaches the detection electrode 66 and lands on the detection electrode 66, as depicted in FIG. 3A. Specifically, the voltage value of the detection electrode 66 rises from a voltage value V1 obtained when the ink-jet head 4 is not driven, and reaches a voltage value V2 higher than the voltage value V1. After the charged ink has landed on the detection electrode 66, the voltage value of the detection electrode 66 gradually decreases from the voltage value V2 and returns to the voltage value V1. A pulse-like voltage signal is thus generated in the detection electrode 66 when the ink is ejected toward the detection electrode 66. That is, the voltage value of the detection electrode 66 changes during a driving period Td of the ink-jet head 4.

Figure 3B:
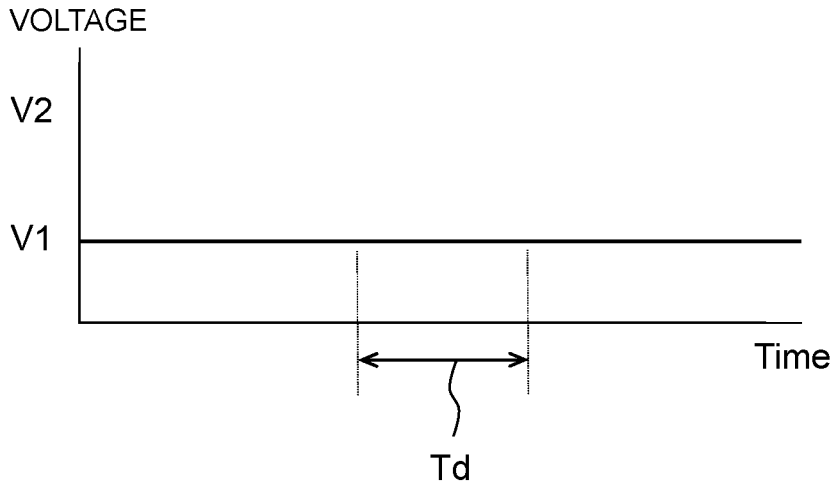
FIG. 3B depicts a change in voltage value of the detection electrode when no ink is ejected from the nozzle.

When ink is not ejected from the nozzle 10, as depicted in FIG. 3B, the voltage value of the voltage signal output from the detection electrode 66 during the driving period Td of the ink-jet head 4 hardly changes from the voltage value V1. Thus, the threshold value Vt (V1<Vt<V2) is set in the determination circuit 68 to distinguish these voltage values. The determination circuit 68 compares a maximum voltage value of the voltage signal output from the detection electrode 66 with the threshold value Vt during the driving period Td of the ink-jet head 4, and outputs a signal corresponding to the determination result. In this embodiment, a combination of the detection electrode 66, the high-voltage power supply circuit 67, the resistance 69, and the determination circuit 68 corresponds to a "signal generator" of the present disclosure. The signal generator outputs, from the determination circuit 68, signals that differ depending on whether the nozzle 10 is an ejection defective nozzle from which no ink is ejected.

In this embodiment, the high-voltage power supply circuit 67 applies the positive potential to the detection electrode 66. The high-voltage power supply circuit 67, however, may apply a negative potential (e.g., about −300V) to the detection electrode 66. In this case, contrary to the above, when ink is ejected from the nozzle 10 to the detection electrode 66 in the state where the carriage 2 is positioned at the maintenance position, the voltage value of the detection electrode 66 decreases from the voltage value V1, until the charged ink approaches the detection electrode 66 and lands on the detection electrode 66. After the charged ink has landed on the detection electrode 66, the voltage value of the detection electrode 66 gradually increases and returns to the voltage value V1.

<Electrical Configuration of Printer>

Next, an electrical configuration of the printer 1 is explained. The operation of the printer 1 is controlled by the controller 80. As depicted in FIG. 4, the controller 80 includes a Central Processing Unit (CPU) 81, a Read Only Memory (ROM) 82, a Random Access Memory (RAM) 83, a flash memory 84, an Application Specific Integrated Circuit (ASIC) 85, and the like. The controller 80 controls operations of the ink-jet head 4, the carriage motor 86, the conveyance motor 87, the cap lifting mechanism 88, the suction pump 62, the high-voltage power supply circuit 67, and the like.

A signal depending on whether the nozzle 10 is the ejection defective nozzle is input from the determination circuit 68 to the controller 80. In addition to the above, the printer 1 includes a display 89 ("alarm" of the present disclosure), an operation section 90, and a communication section 91. The display 89 is, for example, a liquid crystal display. The controller 80 controls the display 89 so that information necessary for operation of the printer 1 is displayed on the display 89. The operation section 90 is, buttons, a touch panel provided in the display 89, and the like. When a user operates the operation section 90, a signal depending on its operation result is input to the controller 80.

The communication section 91 communicates with an external apparatus(es). The printer 1 is configured so that the communication section 91 is connected to an external server 98 via a network 99 such as internet. In this embodiment, a plurality of printers 1 are connected to the server 98 via the network 99. A system 100 is formed by the server 98 and the printers 1 connected to each other via the network 99. Further, the server 98 includes a learning section 97 for performing machine learning described below.

In the controller 80, only the CPU 81 may perform a variety of processes, only the ASIC 85 may perform a variety of processes, or the CPU 81 may cooperate with the ASIC 85 to perform a variety of processes. In the controller 80, one CPU 81 may perform a process alone, or a plurality of CPU 81 may perform a process in a shared fashion. In the controller 80, one ASIC 85 may perform a process alone, or a plurality of ASIC 85 may perform a process in a shared fashion.

<Processes of Regular Purge>

Figure 5:
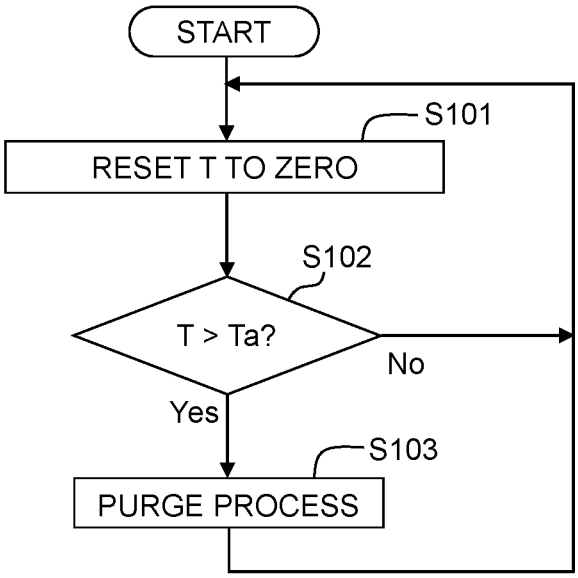
FIG. 5 is a flowchart indicating processes for a regular purge.

The printer 1 performs the suction purge regularly by performing processes in accordance with a flowchart of FIG. 5. The flowchart of FIG. 5 starts, for example, when a socket or outlet of the printer 1 is connected to a commercial power source and the supply of electric power to the printer 1 starts. The flowchart of FIG. 5 continues while electric power is supplied to the printer 1.

More specifically, when electric power is supplied to the printer 1, the controller 80 resets an elapsed time T to zero (S101), and waits until the elapsed time T from this time exceeds a predefined time Ta (S102: NO). When the elapsed time T has exceeded the predefined time Ta (S102: YES), the controller 80 executes a purge process in which the suction purge of "NORMAL" is performed (S103), and returns to the process of S101. The suction purge ("regular maintenance operation" of the present disclosure) is performed regularly every time the predefined time Ta elapses. The ink discharge amount in the suction purge of "NORMAL" is set to a minimum discharge amount by which the ejection defective nozzle is restored through the suction purge executed regularly as described above.

<Processes in Recording>

Next, processes when the printer 1 performs recording on the recording paper P are explained. When the printer 1 performs recording on the recording paper P, the controller 80 performs processes in accordance with a flowchart of FIGS. 6A and 6B. The flowchart of FIG. 6A starts when a recording instruction for instructing the controller 80 to record an image on the recording paper P is input to the controller 80.

Figure 6A:
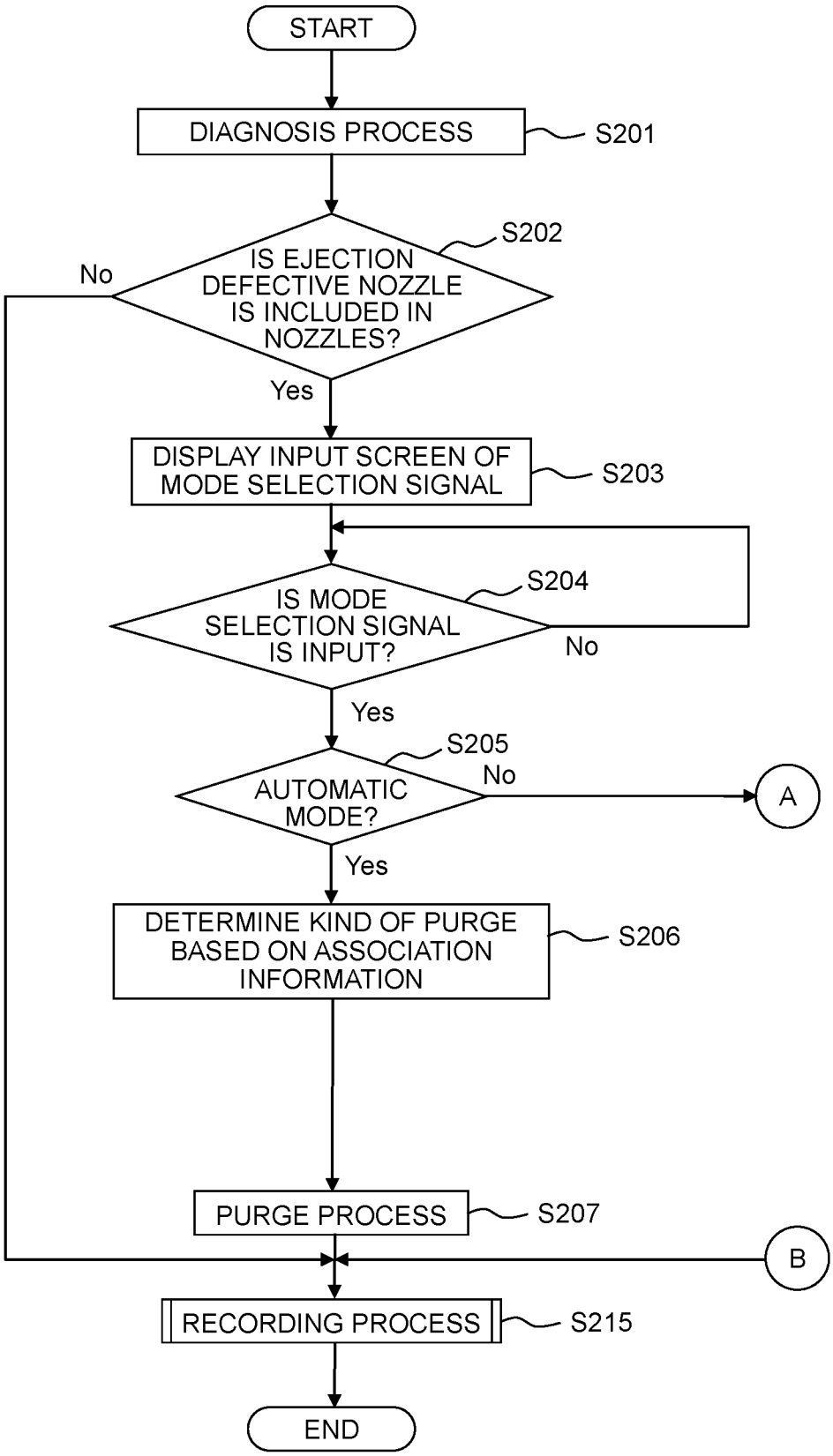
FIGS. 6A and 6B depict flowcharts indicating processes for recording.
Figure 6B:
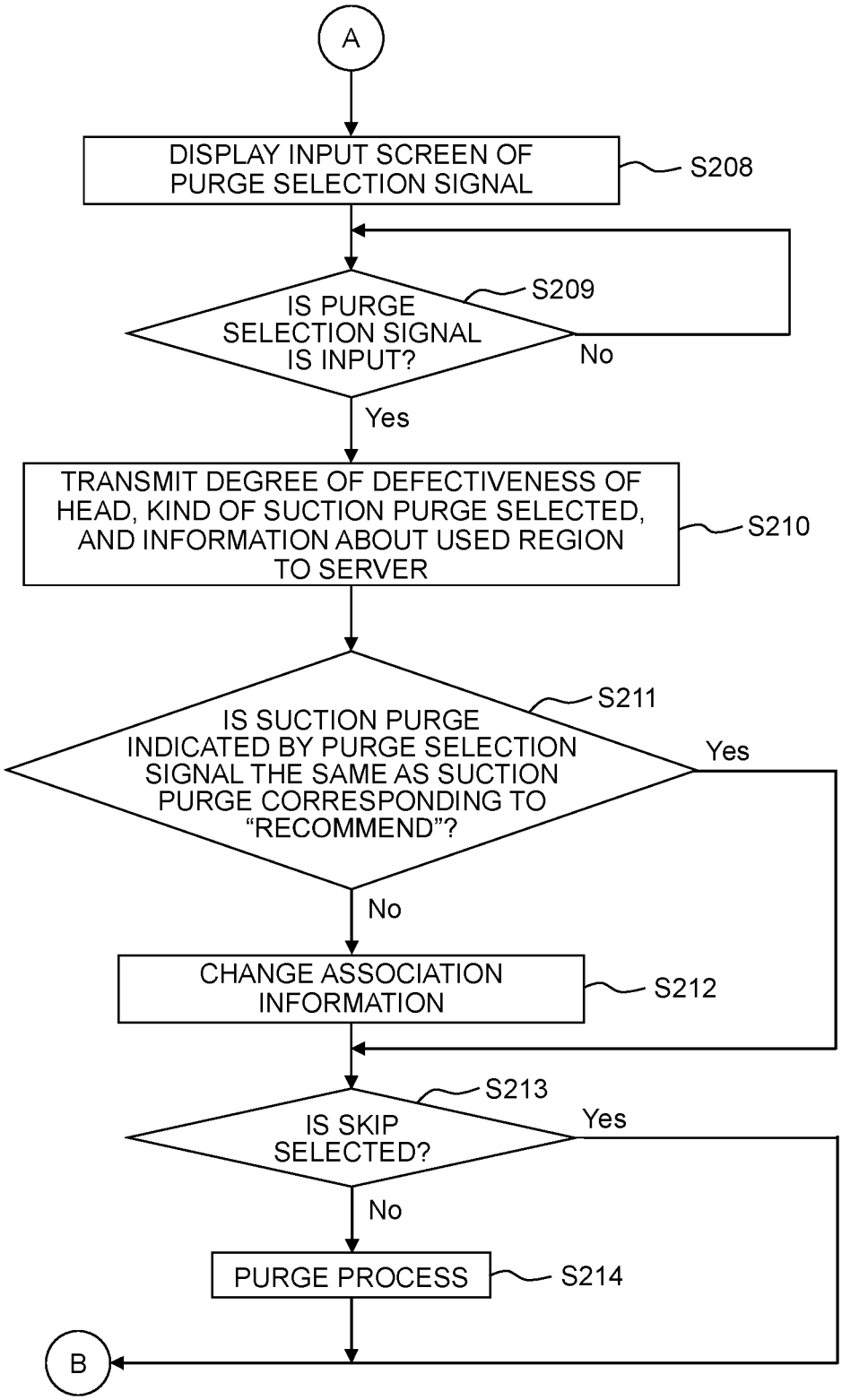

The flowchart of FIGS. 6A and 6B is explained in detail. The controller 80 first executes a diagnosis process (S201). In the diagnosis process of S201, the controller 80 drives the ink-jet head 4 so that inks are ejected from the respective nozzles 10 toward the detection electrode 66 with the carriage 2 being positioned at the maintenance position. In this situation, the controller 80 performs defectiveness determination for determining whether each of the nozzles 10 is the ejection defective nozzle, based on a signal output from the determination circuit 68. The controller 80 diagnoses the degree of defectiveness of the ink-jet head 4 in three levels, for example, "small", "medium", and "large" based on the result of the defectiveness determination for each of the nozzles 10. Regarding "small", "medium", and "large" that mean the degrees of defectiveness of the ink-jet head 4, it is indicated that "medium" is larger in the degree of defectiveness of the ink-jet head 4 than "small", and that "large" is larger in the degree of defectiveness of the ink-jet head 4 than "medium". In this embodiment, the controller 80 diagnoses, for example, that the degree of defectiveness of the ink-jet head 4 is larger as the number of the ejection defective nozzles is larger.

Subsequently, the controller 80 determines whether the ejection defective nozzle is included in the nozzles 10 of the ink-jet head 4 based on the diagnosis result of the diagnosis process of S201 (S202). When the ejection defective nozzle is not included in the nozzles 10 (S202: NO), the controller 80 proceeds to a recording process of S215 described below.

Figure 7A:
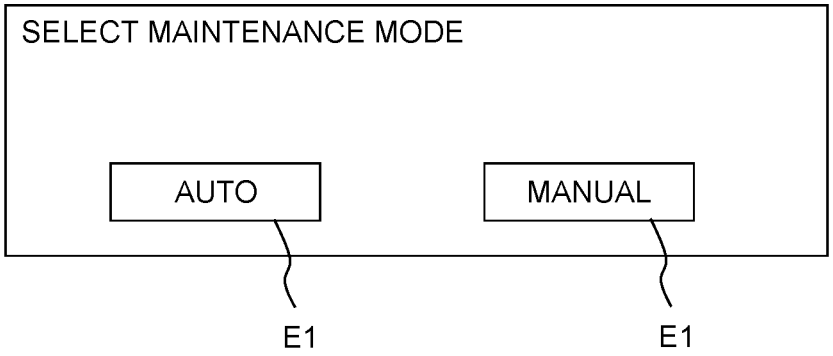
FIG. 7A depicts an input screen of a mode selection signal.

When the ejection defective nozzle is included in the nozzles 10 (S202: YES), the controller 80 transmits a signal to the display 89. This causes the display 89 to display an input screen of a mode selection signal as depicted in FIG. 7A (S203). This screen allows the user to select any of an automatic mode and a manual mode for maintenance. The screen includes a message prompting the user to select the mode, and buttons E1 of "AUTO" and "MANUAL" for allowing the user to select the mode. The controller 80 can receive the input of the mode selection signal for selecting the mode while the screen depicted in FIG. 7A is displayed on the display 89. The user can input, to the controller 80, the mode selection signal indicating that the automatic mode is selected, by selecting the button E1 of "AUTO" in the screen displayed on the display 89. The user can input, to the controller 80, the mode selection signal indicating that the manual mode is selected, by selecting the button E1 of "MANUAL" in the screen displayed on the display 89.

The controller 80 waits until the mode selection signal is input (S204: NO). When the mode selection signal is input (S204: YES), and when the mode selection signal indicates the automatic mode (S205: YES), the controller 80 determines a kind of suction purge (ink discharge amount) for the automatic mode, based on association information described below.

In the flash memory 84 ("memory" of the present disclosure), association information as indicated in FIG. 8A, in which the degrees of defectiveness of the ink-jet head 4 ("small", "medium", and "large" described above) are associated with kinds of suction purges, is stored.

In the process of S206, the controller 80 determines the kind of suction purge to be performed in the automatic mode based on the association information and the degree of defectiveness of the ink-jet head 4 indicated by the diagnosis result in the diagnosis process of S201. Then, the controller 80 executes the purge process so that the suction purge determined in the process of S206 is performed (S207).

Figure 7B:
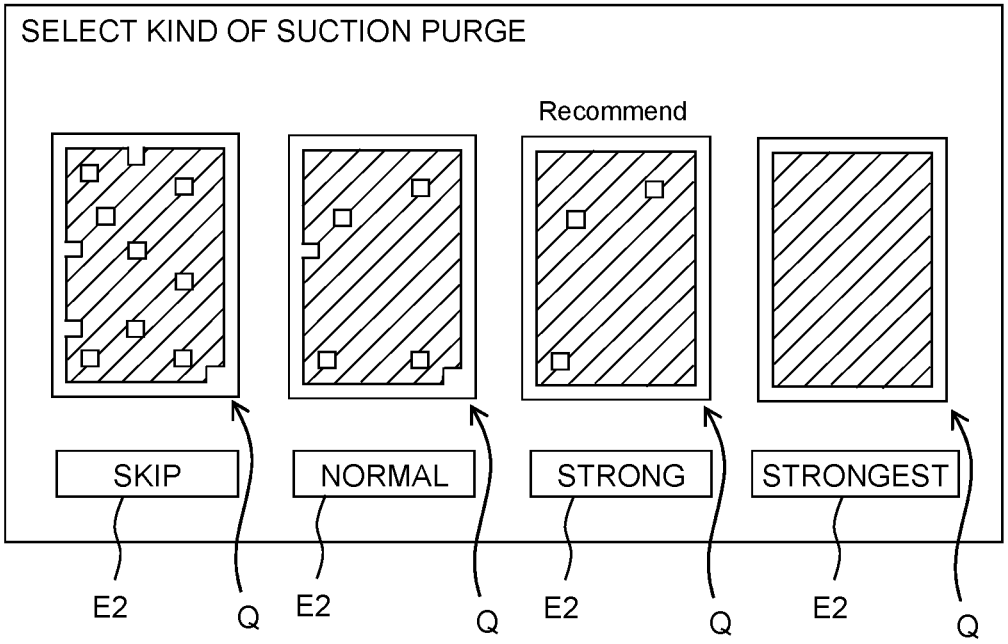
FIG. 7B depicts an input screen of a purge selection signal.

When the mode selection signal indicates the manual mode (S205: NO), the controller 80 transmits an alarm signal to the display 89 so that an input screen of a purge selection signal as depicted in FIG. 7B is displayed on the display 89 (S208). This screen allows the user to select the kind of suction purge. The screen includes: a message prompting the user to select the kind of suction purge; previews Q corresponding to image data that is to be input together with a recording instruction, in a case where the suction purge is not performed and in cases where the suction purges of "NORMAL", "STRONG", and "STRONGEST" are performed respectively; and four buttons E2 of "SKIP", "NORMAL", "STRONG", and "STRONGEST" corresponding to the four previews Q. A message of "Recommend", which indicates a recommended suction purge, is displayed on the screen in FIG. 7B. The message of "Recommend" is positioned above the preview Q corresponding to the suction purge determined based on the association information and the diagnosis result in the diagnosis process of S201. The controller 80 can receive the input of the purge selection signal for selecting the kind of suction purge while the screen depicted in FIG. 7B is displayed on the display 89. In this embodiment, the ink discharge amount in the suction purge depends on the kind of suction purge, and thus the purge selection signal for selecting the kind of suction purge is information about the ink discharge amount in the suction purge, and corresponds to "discharge amount information" of the present disclosure.

In this embodiment, the four previews Q inform the user of the degree of defectiveness of the ink-jet head 4 by displaying the screen of FIG. 7B on the display 89. The user can operate the operation section 90 and select any of the buttons E2 of "NORMAL", "STRONG", and "STRONGEST" displayed on the display 89 at a position below the previews Q corresponding to the three kinds of suction purges. This allows the user to input, to the controller 80, the purge selection signal for selecting any of the three kinds of suction purges. Further, the user can operate the operation section 90 and select the button E2 of "SKIP" displayed on the display 89 at a position below the preview Q corresponding to the case where no suction purge is performed. This allows the user to input, to the controller 80, the purge selection signal indicating that the suction purge is not to be performed.

When the controller 80 waits until the purge selection signal is input (S209: NO), and when the purge selection signal is input (S209: YES), the controller 80 transmits information about the degree of defectiveness of the ink-jet head 4 indicated by the diagnosis result in the diagnosis process of S201, information about the kind of suction purge indicated by the purge selection signal, and information about a used region where the printer 1 is used, to the server 98 via the communication section 91 (S210).

Subsequently, the controller 80 determines whether the suction purge indicated by the purge selection signal is the same as the suction purge determined based on the association information and the diagnosis result in the diagnosis process of S201. Namely, the controller 80 determines whether the suction purge indicated by the purge selection signal is the same as the suction purge corresponding to "Recommend" in FIG. 7B (S211). When the suction purge selected by the user is the same as the suction purge determined based on the association information and the diagnosis result in the diagnosis process of S201 (S211: YES), the controller 80 proceeds to a process of S213. When the suction purge selected by the user is different from the suction purge determined based on the association information and the diagnosis result in the diagnosis process of S201 (S211: NO), the controller 80 changes the association information and proceeds to a process of S213.

In the process of S212, when the ink discharge amount in the suction purge indicated by the purge selection signal is smaller than the ink discharge amount in the suction purge determined based on the association information and the diagnosis result in the diagnosis process of S201, the kinds of suction purges in the association information that correspond to the degrees of defectiveness of the ink-jet head 4 are changed to those having smaller ink discharge amounts. Namely, the kinds of suction purges in the association information that correspond to the degrees of defectiveness of the ink-jet head 4 are changed so that the ink discharge amounts thereof are reduced. However, when the current setting is "NORMAL", the kind of suction purge is not changed and "NORMAL" remains unchanged.

For example, it is assumed that the current association information is the information as indicated in FIG. 8A, that the suction purge determined based on the association information and the diagnosis result in the diagnosis process of S201 is the suction purge of "STRONG", and that the suction purge indicated by the purge selection signal is the suction purge of "NORMAL". In this case, the suction purge in which the degree of defectiveness of the ink-jet head 4 corresponds to "medium" is changed from "STRONG" to "NORMAL", and the suction purge in which the degree of defectiveness of the ink-jet head 4 corresponds to "large" is changed from "STRONGEST" to "STRONG", as depicted in FIG. 8B. Further, the suction purge in which the degree of defectiveness of the ink-jet head 4 corresponds to "small" remains "NORMAL".

When the ink discharge amount of the suction purge indicated by the purge selection signal is larger than the ink discharge amount of the suction purge determined based on the association information and the diagnosis result in the diagnosis process of S201, the controller 80 changes the kinds of suction purges in the association information that correspond to the degrees of defectiveness of the ink-jet head 4 to those having larger ink discharge amounts (so that the ink discharge amounts are increased). In this embodiment, however, the suction purge having the largest ink discharge amount is the suction purge of "STRONGEST". Thus, when the current setting is "STRONGEST", the kind of suction purge is not changed and "STRONGEST" remains unchanged. When it is possible to perform the suction purge of which discharge amount is larger than "STRONGEST", the kind of suction purge may be changed to increase the ink discharge amount of the suction purge of which current setting is "STRONGEST".

For example, it is assumed that the current association information is the information as depicted in FIG. 8A, that the suction purge determined based on the association information and the diagnosis result in the diagnosis process of S201 is the suction purge of "STRONG", and that the suction purge indicated by the purge selection signal is the suction purge of "STRONGEST". In this case, as depicted in FIG. 8C, the suction purge in which the degree of defectiveness of the ink-jet head 4 corresponds to "small" is changed from "NORMAL" to "STRONG", and the suction purge in which the degree of defectiveness of the ink-jet head 4 corresponds to "medium" is changed from "STRONG" to "STRONGEST". Further, the suction purge in which the degree of defectiveness of the ink-jet head 4 corresponds to "large" remains "STRONGEST.

In the process of S212, the controller 80 determines whether "SKIP" is selected. When "SKIP" is selected (S213: YES), the controller 80 proceeds to the recording process of S215. When any other option than "SKIP" is selected, namely when any of "NORMAL", "STRONG", and "STRONGEST" is selected (S213: NO), the controller 80 executes the purge process in which the suction purge indicated by the purge selection signal is performed (S214), and proceeds to the recording process of S215.

Figure 9:
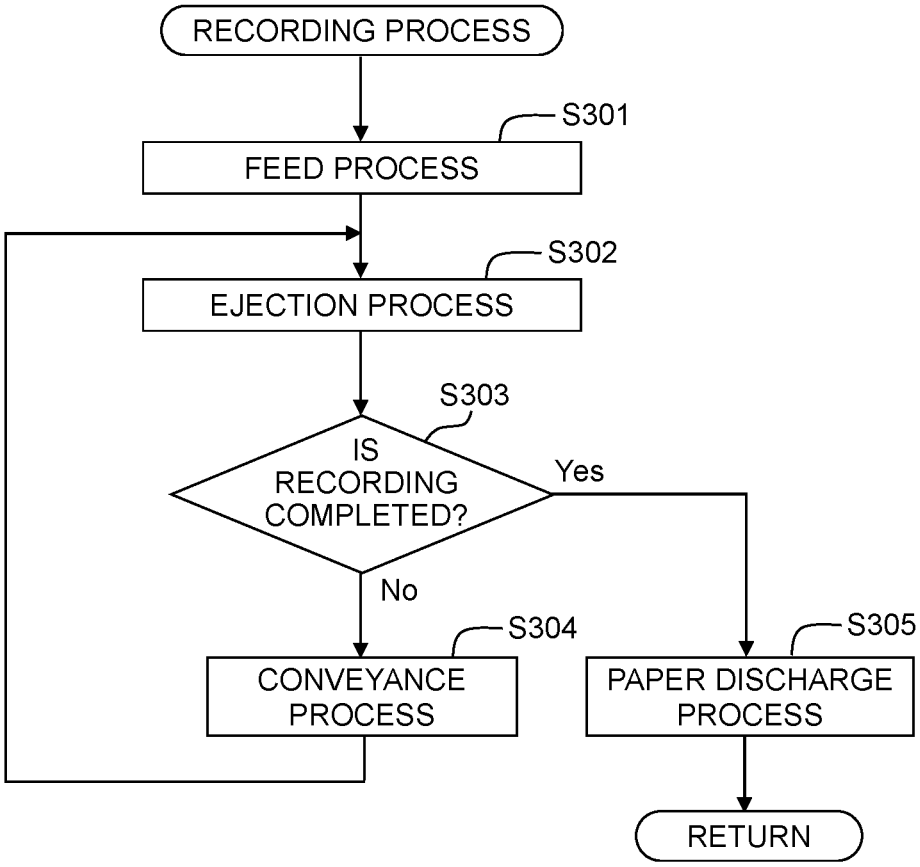
FIG. 9 is a flowchart indicating processes included in a recording process of FIGS. 6A and 6B.

In the recording process of S215, as indicated in FIG. 9, the controller 80 executes a feed process (S301). In the feed process, the controller 80 controls a feed mechanism (not depicted) and the conveyance motor 87 to feed the recording paper P to a recording start position. Then, the controller 80 executes an ejection process (S302). In the ejection process, the controller 80 controls the carriage motor 86 to move the carriage 2 in the scanning direction and controls the ink-jet head 4 to perform the recording pass in which inks are ejected from the nozzles 10 to the recording paper P. When image recording on the recording paper P is not yet completed (S303: NO), the controller 80 executes a conveyance process (S304) and returns to a process of S302. In the conveyance process of S304, the controller 80 controls the conveyance motor 87 to perform the conveyance operation in which the recording paper P is conveyed by use of the conveyance rollers 6 and 7. Accordingly, in the printer 1, the recording pass and the conveyance operation are performed alternatingly until the image recording on the recording paper P is completed. When the image recording on the recording paper P is completed (S303: YES), the controller 80 executes a paper discharge process (S305). In the paper discharge process, the controller 80 controls the conveyance motor 87 to discharge the recording paper P by use of the conveyance rollers 6 and 7. After completion of the conveyance process, the controller 80 returns to the flowchart of FIG. 6A and ends the series of processes.

<Processes in Server>

Figure 10A:
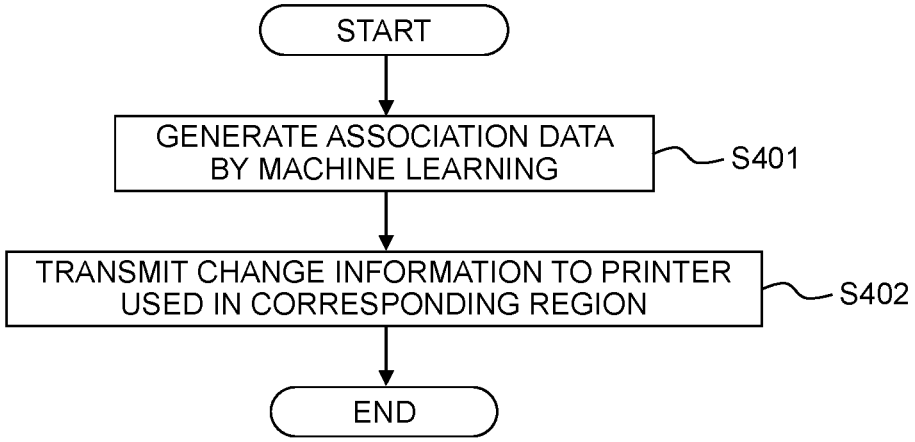
FIG. 10A is a flowchart indicating processes performed in a server.

Subsequently, processes in the server 98 are explained. The server 98 receives information, which is transmitted in the process of S209 from the controllers 80 of the printers 1 connected to the server 98 via the network 99. Then, the server 98 inputs the received information to the learning section 97. In the server 98, as indicated in FIG. 10A, the learning section 97 performs machine learning in which the information input from the printers 1 is used as teacher data, and the server 98 generates optimal association data in which the degrees of defectiveness of the ink-jet heads 4 are optimally associated with the kinds of suction purges (S401).

In the process of S401, the learning section 97 performs the machine learning based on the information about the degrees of defectiveness of the ink-jet heads 4 and the information about the kinds of suction purges selected by the users, for respective used regions of the printers 1. This allows the server 98 to determine the optimal association, in which the degrees of defectiveness of the ink-jet heads 4 are optimally associated with the kinds of suction purges, for the respective used regions of the printers 1. Then, the server 98 generates the association data, in which the degrees of defectiveness of the ink-jet heads 4 are associated with the kinds of suction purges, for the respective used regions of the printers 1.

Then, the server 98 transmits change information, by which the association in the association information of each printer 1 is changed based on the association data generated in the process of S401, to each of the printers 1 used in the corresponding one of the used regions (S402).

Figure 10B:
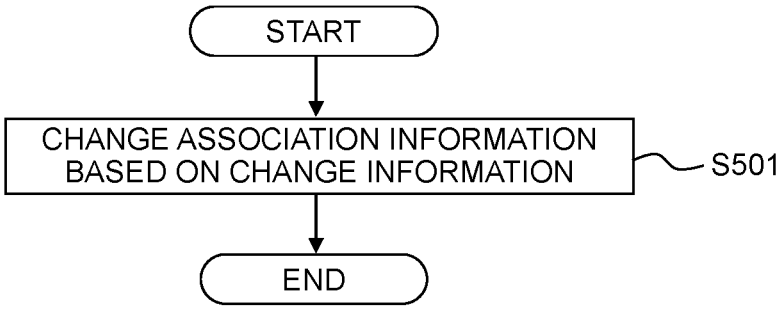
FIG. 10B is a flowchart indicating a process performed by a printer based on change information transmitted from the server.

In each of the printers 10 connected to the server 98 via the network 99, when the controller 80 receives the change information transmitted in the process of S402, the controller 80 changes, based on the received change information, the association in the association information in which the degrees of defectiveness of the ink-jet head 4 are associated with the kinds of suction purges, as indicated in FIG. 10B (S501).

Technical Effects of the Embodiment

In this embodiment, the association information, in which the degrees of defectiveness of the ink-jet head 4 are associated with the kinds of suction purges, for the automatic mode is stored in the flash memory 84. In the automatic mode, the suction purge is performed by automatically determining the kind of suction purge based on the diagnosis result of the diagnosis process for diagnosing the degree of defectiveness of the ink-jet head 4. The association in the association information is changed based on the kind of suction purge determined based on the association information and the diagnosis result of the diagnosis process of S201 as well as the kind of suction purge selected by the manual mode in which the user selects the kind of suction purge. Accordingly, the association in the association information can be changed to association that satisfies user's preference.

In this embodiment, when the ink discharge amount of the suction purge determined based on the association information and the diagnosis result in the diagnosis process of S201 is smaller than the ink discharge amount of the suction purge indicated by the purge selection signal, the kinds of suction purges corresponding to the degrees of defectiveness of the ink-jet head 4 are changed to those having smaller ink discharge amounts. Thus, for example, when the user has a preference in which the ink discharge amount in the suction purge is reduced as much as possible even if the suction purge does not restore the ejection defective nozzle completely, the ink discharge amount in the suction purge that corresponds to the degree of defectiveness of the ink-jet head 4 can be reduced in accordance with the user's preference.

However, in this embodiment, the ink discharge amount in the suction purge of "NORMAL" is the minimum discharge amount by which the ejection defective nozzle can be restored through the regular suction purge. In view of this, in this embodiment, even when the ink discharge amount of the suction purge determined based on the association information and the diagnosis result in the diagnosis process of S201 is smaller than the ink discharge amount of the suction purge indicated by the purge selection signal, the kind of suction purge set to "NORMAL" is not changed, namely, the kind of suction remains "NORMAL". Accordingly, it is possible to ensure an ink discharge amount that is enough to restore the ejection defective nozzle in the regular suction purge while the ink discharge amount in the suction purge that corresponds to the degree of defectiveness of the ink-jet head 4 is reduced in accordance with the user's preference.

Further in this embodiment, when the ink discharge amount of the suction purge determined based on the association information and the diagnosis result in the diagnosis process of S201 is larger than the ink discharge amount of the suction purge indicated by the purge selection signal, the kinds of suction purges corresponding to the degrees of defectiveness of the ink-jet head 4 are changed to those having larger ink discharge amounts. Thus, for example, when the user has a preference in which the ejection defective nozzle is restored reliably through the suction purge even if the ink discharge amount in the suction purge is increased, the ink discharge amount in the suction purge that corresponds to the degree of defectiveness of the ink-jet head 4 can be increased in accordance with the user's preference.

In this embodiment, the controller 80 transmits the alarm signal to the display 89 based on the degree of defectiveness of the ink-jet head 4 indicated by the diagnosis result of the diagnosis process. The controller 80 causes the display 89 to display the previews Q of the image to be recorded, in the case where the suction purge is not performed and in the cases where the respective suction purges are performed, and the controller 80 allows the user to select the kind of suction purge based on the previews Q. Accordingly, the user can select the kind of suction purge that satisfies the user's preference based on the previews Q displayed on the display 89.

In this embodiment, the printers 1 are connected to the server 98 via the network 99. The information about the degree of defectiveness of the ink-jet head 4, the information about the kind of suction purge selected, and the information about the used region where each printer 1 is used are transmitted from each printer 1 to the server 98. In the server 98, the learning section 97 performs the machine learning in which the pieces of information transmitted from the printers 1 are used as teacher data. This allows the server 98 to generate the optimal association data in which the degrees of defectiveness of the ink-jet head 4 are optimally associated with the kinds of suction purges. Based on the generated data, the server 98 transmits the change information for changing the association in the association information to the printers 1. In each printer 1, the association in the association information is changed based on the received change information. Accordingly, it is possible for the server 98 to change the association in the association information of the printers 1 in accordance with the user's preferences of the printers 1 connected to the server 98.

Further, users in the same region (e.g., the same country) may be likely to have a similar preference. In this embodiment, the information transmitted from each printer 1 to the server 98 includes information about the used region of each printer 1. In the server 98, the learning section 97 performs the machine learning, based on the information transmitted from the printers 1 used in the same region, to generate the optimal association data in the same region in which the degrees of defectiveness of the ink-jet heads 4 are optimally associated with the kinds of suction purges. Then, the server 98 transmits the change information to the printers 1 used in same region based on the above data for the same region. Accordingly, it is possible for the server 98 to change the association in the association information of the printers 1 in accordance with the preferences of the users in respective regions where the printers 1 are used.

Modified Embodiments

The embodiment of the present disclosure is explained above. The present disclosure, however, is not limited to the above embodiment. Various changes or modifications may be made without departing from the claims.

In the above embodiment, the information transmitted from the printers 1 to the server 98 includes the information about the used regions of printers 1. In the server 98, the learning section 97 executes the machine learning based on the information transmitted from the printers 1 used in the same region, thus generating the optimal association data in which the degrees of defectiveness of the ink-jet heads 4 are associated with the kinds of suction purges for the same used region. Based on the data for the same used region, the server 98 transmits the change information to the printers 1 that are used in the region corresponding to regional information. The present disclosure, however, is not limited thereto. For example, the information transmitted from the printers 1 to the server 98 may not include the information about the used regions of the printers 1. Further, the server 98 may generate the data based on the information transmitted from the printers 1 irrespective of the used regions of the printers 1, and may transmit the change information to the printers 1 based on this data.

In the above embodiment, the server 98 transmits the change information for changing the association to the printers 1 based on the optimal association data that is generated based on the received information and in which the degrees of defectiveness of the ink-jet heads 4 are optimally associated with the kinds of suction purges. The present disclosure, however, is not limited thereto. For example, the server 98 may generate the data based on the received information. A manufacturer of the printers 1 allows the association information to be stored in the flash memory 84 based on the above data, when the printers 1 are manufactured.

In the above embodiment, the server 98 includes the learning section 97. The learning section 97 performs the machine learning based on the input information, and generates the optimal association data in which the degrees of defectiveness of the ink-jet head 4 are optimally associated with the kinds of suction purges. The present disclosure, however, is not limited thereto. For example, someone may analyze information gathered in the server 98 and may generate optimal association data in which the degrees of defectiveness of the ink-jet head 4 are optimally associated with the kinds of suction purges. Further, the server 98 may be configured by one computer. Or the server 98 may be configured by computers connected to each other via network. In this case, the learning section 97 may be configured by at least one computer from among the computers included in the server 98.

In the above embodiment, the printers 1 are connected to the server 98 via the network 99. Information is transmitted from the printers 1 to the server 98. The present disclosure, however, is not limited thereto. The information may not be transmitted from the printers 1 to the server 98, and the change information corresponding thereto may not be transmitted from the server 98 to the printers 1. In this case, the printer 1 may not include the communication section 91 used for connection with the network 99.

In the above embodiment, the controller 80 causes the display 89 to display the previews Q of the image to be recorded, in the case where the suction purge is not performed and in the cases where the respective suction purges are performed. This allows the user to select the kind of the suction purge. The present disclosure, however, is not limited thereto. For example, the controller 80 may cause the display 89 to display the preview Q of the image to be recorded, only in the case where the suction purge is not performed. This may allow the user to select the kind of suction purge based on this preview Q. Also in this case, the user can select, for example, the suction purge in which the ink discharge amount is larger as the number of voids (white spots) in the preview Q is larger.

The previews Q displayed on the display 89 may not correspond to the image data that is input together with the recording instruction. For example, image data of an image as a sample may be stored in the flash memory 84 in advance. A preview of the image as the sample may be displayed on the display 89.

Further, it is not indispensable for the controller 80 to perform the operation in which the previews Q of the image to be recorded are displayed on the display 89 so that the user is informed of the degree of defectiveness of the ink-jet head 4. For example, the controller 80 may inform the user of the degree of defectiveness of the ink-jet head 4 by causing the display 89 to display information about a ratio of the ejection defective nozzle(s) to the nozzles 10 in the ink-jet head 4. Or, for example, the printer 1 may be provided with an LED lamp. In this case, the LED lamp may inform the user of the degree of defectiveness of the ink-jet head 4 by varying light generation (emission) depending on the degree of defectiveness of the ink-jet head 4. Examples of the light generation of the LED lamp include the lighting of the LED lamp, the blinking of the LED lamp, and the change in blinking interval of the LED lamp. The printer 1 may inform the user of the degree of defectiveness of the ink-jet head 4 as described above. Or, for example, the printer 1 may be provided with a speaker. The controller 80 may inform the user of the degree of defectiveness of the ink-jet head 4 by emitting or making a sound depending on the degree of defectiveness of the ink-jet head 4.

The printer 1 may not be provided with the alarm for informing the user of the degree of defectiveness of the ink-jet head 4. For example, when a PC is connected to the printer 1, the controller 80 can transmit, to the PC, an alert signal for informing the user of the degree of defectiveness of the ink-jet head 4. The PC receiving the alert signal may display a screen, by which the user is informed of the degree of defectiveness of the ink-jet head 4, on a display of the PC.

In the above embodiment, the association in the association information is changed both of when the ink discharge amount of the suction purge selected by the user is smaller than the ink discharge amount of the suction purge determined based on the association information and the diagnosis result in the diagnosis process, and when the ink discharge amount of the suction purge selected by the user is larger than the ink discharge amount of the suction purge determined based on the association information and the diagnosis result in the diagnosis process. The present disclosure, however, is not limited thereto.

For example, the association in the association information in which the degrees of defectiveness of the ink-jet head 4 are associated with the kinds of suction purges may be changed only in any one of the case where the ink discharge amount of the suction purge selected by the user is smaller than the ink discharge amount of the suction purge determined based on the association information and the diagnosis result in the diagnosis process and the case where the ink discharge amount of the suction purge selected by the user is larger than the ink discharge amount of the suction purge determined based on the association information and the diagnosis result in the diagnosis process.

In the above embodiment, the ink discharge amount of the suction purge of "NORMAL" is set to the minimum discharge amount by which the ejection defective nozzle is restored through the regular suction purge described above. In this embodiment, when the kinds of suction purges in the association information that are associated with the degrees of defectiveness of the ink-jet head 4 are changed to those having smaller ink discharge amounts, the kind of suction purge currently set to "NORMAL" remains "NORMAL". The present disclosure, however, is not limited thereto. For example, it may be possible to perform the suction purge of which ink discharge amount is smaller than "NORMAL". In that case, when the kinds of suction purges in the association information that are associated with the degrees of defectiveness of the ink-jet head 4 are changed to those having smaller ink discharge amounts, the kind of suction purge currently set to "NORMAL" may be changed to the kind of suction purge having a smaller ink discharge amount than "NORMAL".

In the above embodiment, the association information is the association information for the automatic mode in which the degrees of defectiveness of the ink-jet head 4 are associated with the kinds of suction purges. The present disclosure, however, is not limited thereto. For example, the controller 80 may determine whether the nozzle 10 is the ejection defective nozzle, based on the signal from the determination circuit 68. When the suction purge is performed based on the determination result, any other mode than the automatic mode may be used. In this configuration, the suction purge depending on the user' selection may be ordinarily performed. Further, for example, association information in which the degrees of defectiveness of the ink-jet head 4 are associated with the kinds of suction purges, similar to FIG. 8A, may be stored in the flash memory 84. Then, in an input screen for the purge selection signal similar to FIG. 7B, "Recommend" may be added to the preview Q of the case where the suction purge determined based on the association information and the degree of defectiveness of the ink-jet head 4 indicated by the diagnosis result in the diagnosis process is performed. This allows the user to be appropriately informed of the kind of suction purge recommended, depending on the degree of defectiveness of the ink-jet head 4.

In the above embodiment, when the kind of suction purge in the association information that corresponds to the degree of defectiveness of the ink-jet head 4 indicated by the diagnosis result in the diagnosis process is different from the kind of suction purge indicated by the purge selection signal, the association in the association information in which the degrees of defectiveness of the ink-jet head 4 are associated with the kinds of suction purges is changed. The present disclosure, however, is not limited thereto.

For example, in the first modified embodiment, the association information, similar to the above embodiment, in which the degrees of defectiveness of the ink-jet head 4 are associated with the kinds of suction purges (information in FIG. 8A, hereinafter referred to as first information) and association information (hereinafter referred to as second information) associated with driving times of the suction pump 62 in the suction purge are stored in the flash memory 84. Here, driving times T1, T2, and T3 of the suction pump 62 in FIG. 11A satisfy a relationship of T1<T2<T3. The ink discharge amount in the suction purge is larger, as the driving time of the suction pump 62 is longer. Namely, the driving time of the suction pump 62 in FIG. 11A corresponds to the ink discharge amount in the suction purge. In this case, a combination of the first information and the second information corresponds to "association information" of the present disclosure.

When the kind of suction purge determined based on the first information and the diagnosis result of the diagnosis process is different from the kind of suction purge indicated by the purge selection signal, the driving time of the suction pump 62 in the second information is changed.

In the first modified embodiment, the second information is the association information in which the kinds of suction purges are associated with the driving times of the suction pump 62 in the suction purge. The present disclosure, however, is not limited thereto. For example, in the second modified embodiment, association information, as indicated in FIG. 11B, in which the kinds of suction purges are associated with rotation velocities of the suction pump 62 in the suction purge, is stored as the second information. The rotation velocities U1, U2, U3 of the suction pump 62 in FIG. 11B satisfy a relationship of U1<U2<U3. The ink discharge amount in the suction purge is larger, as the rotation velocity of the suction pump 62 is faster. Namely, the rotation velocity of the suction pump 62 in FIG. 11B corresponds to the ink discharge amount in the suction purge.

When the kind of suction purge determined based on the first information and the diagnosis result in the diagnosis process is different from the kind of suction purge indicated by the purge selection signal, the rotation velocity of the suction pump 62 in the second information is changed.

The second information is association information in which the kinds of suction purges are associated with any other parameters related to the ink discharge amounts in the suction purge. When the kind of suction purge determined based on the first information and the diagnosis result in the diagnosis process is different from the kind of suction purge indicated by the purge selection signal, the controller 80 may change a value of the parameter in the second information.

In the above embodiment, when the kind of suction purge indicated by the purge selection signal is different from the kind of suction purge determined based on the association information and the diagnosis result in the diagnosis process, the controller 80 changes the association information quickly. The present disclosure, however, is not limited thereto. For example, when a state, in which the ink discharge amount of the suction purge indicated by the purge selection signal is smaller than the ink discharge amount of the suction purge determined based on the association information and the diagnosis result in the diagnosis process, continues a predefined times of more, the controller 80 may change the kinds of suction purges corresponding to the degrees of defectiveness of the ink-jet head 4 to those having smaller ink discharge amounts. Or, when a state, in which the ink discharge amount of the suction purge indicated by the purge selection signal is larger than the ink discharge amount of the suction purge determined based on the association information and the diagnosis result in the diagnosis process, continues a predefined times of more, the controller 80 may change the kinds of suction purges corresponding to the degrees of defectiveness of the ink-jet head 4 to those having larger ink discharge amounts.

In the above embodiment, the controller 80 selectively executes any of the kinds of suction purges having different ink discharge amounts. The present disclosure, however, is not limited thereto. For example, it is possible to adopt flushing, as the discharge operation, in which inks are ejected from the nozzles 10 by driving the ink-jet head 4. The controller 80 may selectively perform any one of a plurality of kinds of flushing having different ink discharge amounts. In this case, it is possible to vary ink discharge amounts, for example, by varying the number of times of driving of the ink-jet head 4 between the kinds of flushing. In this case, the ink-jet head 4 functions as the "head" and the "discharge mechanism" of the present disclosure.

Or, for example, it is possible to adopt a plurality of kinds of discharge operations that have different ink discharge amounts and that include at least one kind of suction purge and at least one kind of flushing. The controller 80 may be configured to control the maintenance unit 8 and the ink-jet head 4 to selectively execute any of the discharge operations. In this case, a combination of the maintenance unit 8 and the ink-jet head 4 corresponds to the "discharge mechanism" of the present disclosure.

In the above embodiment, the suction purge is performed as the purge. The present disclosure, however, is not limited thereto. For example, a pressurization pump may be provided in a tube 13 connecting the subtank 3 and the ink cartridges 15. Or, a pressurization pump connected to the ink cartridges 15 may be provided in the printer 1. A so-called pressurizing purge may be performed in which the pressurization pump is driven in a state where the nozzles 10 are covered with the cap 61 to pressurize the inks in the ink jet head 4, thereby discharging the inks in the ink-jet head 4 from the nozzles 10. In this case, a combination of the cap 61 and the pressurization pump corresponds to the "discharge mechanism" of the present disclosure.

Further, both of the suction by the suction pump 62 and the pressurization by the pressurization pump may be performed in the purge. In this case, a combination of the maintenance unit 8 and the pressurization pump corresponds to the "discharge mechanism" of the present disclosure.

In the above embodiment, the controller 80 can selectively perform any of the three kinds of suction purges. The user inputs the purge selection signal as the discharge amount information by selecting the kind of suction purge. The present disclosure, however, is not limited thereto. For example, the user may input another discharge amount information about the ink discharge amount, such as information about an ink discharge amount itself, so that the inks in the ink-jet head 4 are discharged from the nozzles 10 by the discharge operation, such as the suction purge, by a discharge amount indicated by the input discharge amount information.

In the above embodiment, the determination circuit 68 outputs the signal indicating whether the nozzle 10 is the ejection defective nozzle, depending on the voltage value of the detection electrode 66 obtained when ink is ejected from the nozzle 10 toward the detection electrode 66. The present disclosure, however, is not limited thereto.

For example, a detection electrode extending in an up-down direction may be provided in the printer 1. The determination circuit 68 may output the signal indicating whether the nozzle 10 is the ejection defective nozzle, depending on a voltage value of the detection electrode that is obtained when the ink ejected from the nozzle 10 passes through an area facing the detection electrode. Or, an optical sensor that detects the ink ejected from the nozzle 10 may be provided in the printer 1. The optical sensor may output a signal indicating whether the nozzle 10 is the ejection defective nozzle.

Or, for example, slimier to a configuration described in United States Patent Application Publication No. 2007/0139461 A1, a voltage detection circuit ("signal generator" of the present disclosure) that detects a change in voltage when ink is ejected from the nozzle may be connected to a plate in which the nozzles of the ink-jet head are formed, and a signal indicating whether the nozzle is the ejection defective nozzle may be output from the voltage detection circuit to the controller 80. The disclosure of United States Patent Application Publication No. 2007/0139461 A1 is incorporated herein by reference in its entirety.

Or, for example, similar to a configuration described in United States Patent Application Publication No. 2014/0300657 A1, a substrate of the ink-jet head may include a temperature detecting element. In this configuration, a heater may be driven by applying the first application voltage to eject ink, and then the heater may be driven by applying the second application voltage not to eject ink. A signal indicating whether the nozzle 10 is the ejection defective nozzle may be output in response to a change in temperature detected by the temperature detecting element after the second application voltage is applied until a predefined time elapses. The disclosure of United States Patent Application Publication No. 2014/0300657 A1 is incorporated herein by reference in its entirety.

In the above embodiment, it is determined that the nozzle 10 from which no ink is ejected is the ejection defective nozzle. The present disclosure, however, is not limited thereto. For example, a configuration in which an ejection velocity of ink from the nozzle 10, an ejection direction of ink from the nozzle 10, and/or the like is/are detected may be provided, and it may be determined that the nozzle 10 in which the ejection velocity of ink, the ejection direction of ink, and/or the like is/are defective may be determined as the ejection defective nozzle.

In the above embodiment, the determination whether the nozzle 10 is the ejection defective nozzle is performed for all the nozzles 10 of the ink-jet head 4. The degree of defectiveness of the ink-jet head 4 is diagnosed based on the result. The present disclosure, however, is not limited thereto. For example, the determination whether the nozzle 10 is the ejection defective nozzle may be performed for some of the nozzles 10 provided in the ink-jet head 4. The degree of defectiveness of the ink-jet head 4 may be diagnosed based on the result.

In the above embodiment, the ink-jet head 4 is a serial type head that is carried on the carriage 2 and ejects ink(s) from the nozzles 10 during the movement in the scanning direction. The present disclosure, however, is not limited thereto. For example, the ink-jet head may be a line head that extends over an entire length in the scanning direction of the recording paper P.

The examples in which the present disclosure is applied to the printer that ejects ink(s) from nozzles to perform recording on the recording paper P are explained above. The present disclosure, however, is not limited thereto. The present disclosure can be applied to an image recording apparatus that performs image recording on any other recording medium than the recording paper, such as a T-shirt, a sheet for out-of-home advertising, a case of a mobile terminal including a smartphone, cardboard, and a resin member. Further, the present disclosure is applicable to a liquid ejection apparatus ejecting any other liquid than ink, such as liquefied resin and liquefied metal.

What is claimed is:

1. A liquid ejection apparatus, comprising:

a head in which a plurality of nozzles are open, a signal generator configured to output a signal such that the signal varies depending on whether an ejection defective nozzle having defectiveness in liquid ejection is included in the nozzles, a discharge mechanism configured to perform a discharge operation in which a liquid in the head is discharged from the nozzles, a controller configured to:

diagnose a degree of the defectiveness of the head by performing defectiveness determination to determine, based on the signal from the signal generator, whether the ejection defective nozzle is included in the nozzles; and receive, from a user, an input of discharge amount information that is related to a discharge amount of the liquid in the discharge operation, and a notifier configured to notify a user of a recommended discharge amount information corresponding to the degree of the defectiveness of the head indicated by the result of the defectiveness determination, wherein, in response to the input of the discharge amount information, the controller is configured to:

control the discharge mechanism to discharge the liquid by a discharge amount corresponding to the discharge amount information.

2. The liquid ejection apparatus according to claim 1, further comprising a communication section configured to communicate with an external server, wherein, in response to the input of the discharge amount information, the controller is configured to transmit information about the degree of the defectiveness of the head indicated by the result of the defectiveness determination and information about the discharge amount of the liquid corresponding to the discharge amount information, to the server via the communication section.

3. The liquid ejection apparatus according to claim 1, wherein the controller is configured to:

output, based on the result of the defectiveness determination, a notification signal that allows the user to be informed of the degree of the defectiveness of the head, to the notifier, and become a state where the controller is ready to receive the input of the discharge amount information from the user based on a notification of the notifier.

4. The liquid ejection apparatus according to claim 3, further comprising a display as the notifier, wherein the controller is configured to:

control the liquid discharge head to record an image on the recording medium by discharging the liquid on the recording medium from the nozzles, and output the notification signal to the display based on the result of the defectiveness determination, wherein the notification signal is a signal by which the degree of the defectiveness of the head is displayed on the display by displaying, on the display, a preview of the image to be recorded in a case that the image is recorded without restoring the ejection defective nozzle.

5. The liquid ejection apparatus according to claim 1, wherein in a case that the discharge amount corresponding to the discharge amount information is larger than the discharge amount corresponding to the degree of the defectiveness of the head indicated by the result of the defectiveness determination, the controller is configured to change the association in the association information such that the discharge amount corresponding to the degree of the defectiveness of the liquid ejection is increased.

6. The liquid ejection apparatus according to claim 2, wherein the controller is configured to further transmit information about a region or area where the liquid ejection apparatus is used, from the communication section to the server.

7. The liquid ejection apparatus according to claim 1, wherein in a case that a first degree of the defectiveness of the head is smaller than a second degree of the defectiveness of the head, a first discharge amount of the liquid associated with the first degree of the defectiveness is less than a second discharge amount of the liquid associated with the second degree of the defectiveness of the head.

8. The liquid ejection apparatus according to claim 1, wherein the discharge amount corresponding to the discharge amount information is greater than 0.

9. The liquid ejection apparatus according to claim 1, further comprising a memory configured to store association information including the degree of the defectiveness of the head associated with the discharge amount of the liquid in the discharge operation, wherein the controller is configured to:

determine the discharge amount based on the association information such that the discharge amount corresponds to the degree of the defectiveness of the head, and change the association in the association information based on the discharge amount information and the degree of the defectiveness of the head indicated by the result of the defectiveness determination.

10. A liquid ejection apparatus, comprising:

a head in which a plurality of nozzles are open, a signal generator configured to output a signal such that the signal varies depending on whether an ejection defective nozzle having defectiveness in liquid ejection is included in the nozzles, a discharge mechanism configured to perform a discharge operation in which a liquid in the head is discharged from the nozzles, a controller configured to:

diagnose a degree of the defectiveness of the head by performing defectiveness determination to determine, based on the signal from the signal generator, whether the ejection defective nozzle is included in the nozzles; and receive, from a user, an input of discharge amount information that is related to a discharge amount of the liquid in the discharge operation, and a memory configured to store association information including the degree of the defectiveness of the head associated with the discharge amount of the liquid in the discharge operation, wherein, in response to the input of the discharge amount information, the controller is configured to change the association in the association information based on the discharge amount information and the degree of the defectiveness of the head indicated by the result of the defectiveness determination, wherein, in a case that the discharge amount corresponding to the discharge amount information is smaller than the discharge amount in the association information corresponding to the degree of the defectiveness of the head indicated by the result of the defectiveness determination, the controller is configured to change the association in the association information such that the discharge amount corresponding to the degree of the defectiveness of the head is reduced, wherein the controller is configured to:

control the discharge mechanism to perform a regular discharge operation as the discharge operation every time a predefined time elapses, in a case that the discharge amount corresponding to the discharge amount information is smaller than the discharge amount of the liquid corresponding to the degree of the defectiveness of the head indicated by result of the defectiveness determination, change the association in the association information such that the discharge amount corresponding to the degree of the defectiveness of the liquid discharge head is reduced within a range that is equal to or more than a minimum discharge amount by which the ejection defective nozzle is restored through the regular discharge operation.

11. The liquid ejection apparatus according to claim 10, wherein the controller is configured to control the discharge mechanism to perform the discharge operation in a manual mode or in an automatic mode, selectively, the manual mode being a mode in which, in a case that the discharge amount information based on the result of the defectiveness determination is input from the user, the controller controls the discharge mechanism to perform the discharge operation such that the liquid is discharged by the discharge amount corresponding to the discharge amount information, the automatic mode being a mode in which the discharge amount of the liquid in the discharge operation is determined automatically based on the result of the defectiveness determination by the controller, and the controller controls the discharge mechanism to perform the discharge operation such that the liquid is discharged by a discharge amount determined, the controller is configured to:

determine, in the automatic mode, the discharge amount of the liquid in the discharge operation based on the association information and the result of the defectiveness determination, and change the association in the association information, in response to the input of the discharge amount information in the automatic mode, based on the the discharge amount information and the degree of the defectiveness of the head indicated by the result of the defectiveness determination.

12. The liquid ejection apparatus according to claim 10, wherein, in a case that the discharge amount corresponding to the discharge amount information is smaller than the discharge amount in the association information corresponding to the degree of the defectiveness of the head indicated by the result of the defectiveness determination, the controller is configured to change the association in the association information such that the discharge amount corresponding to the degree of the defectiveness of the head is reduced.

13. The liquid ejection apparatus according to claim 12, wherein the controller is configured to:

control the discharge mechanism to perform a regular discharge operation as the discharge operation every time a predefined time elapses, in a case that the discharge amount corresponding to the discharge amount information is smaller than the discharge amount of the liquid corresponding to the degree of the defectiveness of the head indicated by result of the defectiveness determination, change the association in the association information such that the discharge amount corresponding to the degree of the defectiveness of the liquid discharge head is reduced within a range that is equal to or more than a minimum discharge amount by which the ejection defective nozzle is restored through the regular discharge operation.

14. A liquid ejection apparatus, comprising:

a head in which a plurality of nozzles are open, a signal generator configured to output a signal such that the signal varies depending on whether an ejection defective nozzle having defectiveness in liquid ejection is included in the nozzles, a discharge mechanism configured to perform a discharge operation in which a liquid in the head is discharged from the nozzles, a controller configured to:

diagnose a degree of the defectiveness of the head by performing defectiveness determination to determine, based on the signal from the signal generator, whether the ejection defective nozzle is included in the nozzles; and receive, from a user, an input of discharge amount information that is related to a discharge amount of the liquid in the discharge operation, a communication section configured to communicate with an external server, and a memory configured to store association information including the degree of the defectiveness of the head associated with the discharge amount of the liquid in the discharge operation, wherein, in response to the input of the discharge amount information, the controller is configured to change the association in the association information based on the discharge amount information and the degree of the defectiveness of the head indicated by the result of the defectiveness determination, wherein, in response to the input of the discharge amount information, the controller is configured to transmit information about the degree of the defectiveness of the head indicated by the result of the defectiveness determination and information about the discharge amount of the liquid corresponding to the discharge amount information, to the server via the communication section.

15. A liquid ejection apparatus, comprising:

a head in which a plurality of nozzles are open, a signal generator configured to output a signal such that the signal varies depending on whether an ejection defective nozzle having defectiveness in liquid ejection is included in the nozzles, a discharge mechanism configured to perform a discharge operation in which a liquid in the head is discharged from the nozzles, a notifier including a display, and a controller configured to:

diagnose a degree of the defectiveness of the head by performing defectiveness determination to determine, based on the signal from the signal generator, whether the ejection defective nozzle is included in the nozzles; and receive, from a user, an input of discharge amount information that is related to a discharge amount of the liquid in the discharge operation, wherein, in response to the input of the discharge amount information, the controller is configured to control the discharge mechanism to discharge the liquid by a discharge amount corresponding to the discharge amount information, wherein the controller is configured to:

output, based on the result of the defectiveness determination, a notification signal that allows the user to be informed of the degree of the defectiveness of the head, to the notifier, become a state where the controller is ready to receive the input of the discharge amount information from the user based on a notification of the notifier, control the liquid discharge head to record an image on the recording medium by discharging the liquid on the recording medium from the nozzles, and output the notification signal to the display based on the result of the defectiveness determination, wherein the notification signal is a signal by which the degree of the defectiveness of the head is displayed on the display by displaying, on the display, a preview of the image to be recorded in a case that the image is recorded without restoring the ejection defective nozzle.

* * * * *